US005246473A

United States Patent [19]

Harris

[11] Patent Number: 5,246,473

[45] Date of Patent: Sep. 21, 1993

[54] HIGH PERFORMANCE EXHAUST MUFFLER

[76] Inventor: Graeme Harris, 95 Strickland Street, Christchurch, New Zealand

[21] Appl. No.: 909,586

[22] Filed: Jul. 8, 1992

[30] Foreign Application Priority Data

Jul. 8, 1991 [NZ] New Zealand ..... 238869

[51] Int. Cl.[5] ..... B01D 45/06

[52] U.S. Cl. ..... 55/276; 55/DIG. 30; 55/319; 181/231; 181/249

[58] Field of Search ..... 55/276, DIG. 30, 319; 181/231, 247, 248, 249

[56] References Cited

U.S. PATENT DOCUMENTS 1,972,065 8/1934 Noblitt ..... 181/249
3,329,237 7/1967 Straw ..... 181/249
3,677,364 7/1972 Pawlina ..... 55/276 X
3,757,892 9/1973 Raudman ..... 55/276 X
4,574,913 3/1986 Fukuda ..... 181/231

*Primary Examiner*—Charles Hart
*Attorney, Agent, or Firm*—Christensen, O'Connor, Johnson & Kindness

[57] ABSTRACT

A high performance exhaust muffler which improves engine power and economy as well as providing a smoother engine performance. The muffler comprises an exhaust gas expansion section and a tubular baffle section closed or partially blocked at one end, its open end being attached within a smaller end of the exhaust gas expansion section to allow gas to pass directly into the exhaust gas expansion section and some to pass into the baffle section causing a weak back pressure to pulse back along the baffle tube.

15 Claims, 3 Drawing Sheets

HIGH PERFORMANCE EXHAUST MUFFLER

FIELD OF THE INVENTION

This invention relates to a high performance exhaust muffler, silencer or pre-silencer for engines and other gas-flow applications.

BACKGROUND OF THE INVENTION

An object of the invention is to provide a high performance muffler, silencer or pre-silencer for controlling the gas flows from internal combustion engines, or gas flows in other applications which use mufflers, silencers or pre-silencers.

A further object of this invention is to improve engine power and economy and to provide smoother engine performance.

Further objects and advantages of the invention will become apparent from the following description which is given by way of example only.

SUMMARY OF THE INVENTION

In its broadest aspect the invention provides a muffler, silencer or pre-silencer including an optional connecting tube, an exhaust gas expansion section, an optional second section and a perforated, louvred or plain tubular baffle section. The arrangement is such that a smaller end of the exhaust gas expansion section acts as the inlet which can be attached to one end of the optional connecting tube the other end of which acts as an inlet and is adapted for connection to an exhaust pipe or gas flow pipe. The other and larger end of the exhaust gas expansion section is either the outlet or is attached to a second section the other end of which acts as the outlet. The perforated, louvered or plain baffle section is at least partially closed at one end and its open end is attached within the smaller end of the exhaust gas expansion section to allow exhaust gas to flow either directly into the exhaust gas expansion section through a peripheral gap or through the perforated, louvered or plain tubular baffle section which passes a weak back pressure pulse back along the baffle section.

The baffle section, if plain, needs the end to be partially open so that the gas flow returns a proportionally stronger back pressure pulse.

The open end of the baffle section is mounted internally at or near the inlet of the exhaust gas expansion section and finishes before, at or after the outlet of the second section, and can be mounted centrally or offset from the center of the exhaust gas expansion section.

The exhaust gas expansion section can be any shape in section which gives a sudden or large expansion in the cross-sectional area of the section so that the gas flow accelerates through the peripheral gap between the open end of the baffle section and the expansion section.

The optional second section can be parallel to or tapered relative to the exhaust gas expansion section and terminates in a suitable outlet.

The exhaust gas expansion section and the optional second section can be conical. The muffler can be constructed with a length and taper angles which suits the type of engine onto which it is to be fitted and the operating range of the engine.

The baffle section is mounted at or near to the inlet of the exhaust gas expansion section such that there is a peripheral gap between the open end of the baffle section and the exhaust gas expansion section. By varying the position of the baffle section the size of this gap is able to be varied and thus changes in gas flow patterns can be achieved. This variation in the position of the baffle section allows for "tuning" of the muffler for various engine revolutions per minute and gas flow requirements.

The muffler can additionally be tuned by altering the length of the baffle section as this affects the timing of the back pressure pulse of the muffler and also by varying the degree of porosity of the tubular baffle section. The strength of the back pressure pulse varies and the exhaust gas flow rate through the baffle section will vary. Tuning can also be achieved by varying the amount the end of the baffle section is blocked.

The muffler while principally designed for high performance vehicles can also be used as a pre-silencer for other vehicles and in other gas flow situations.

A protrusion or obstruction or protrusions or obstructions can be added to the internal surface of the optional connecting tube and/or the exhaust gas expansion section to increase the resistance to the gas flow and thus to change the "tuning" condition of the muffler.

The outlet of the baffle section can be filled by any suitable means of attachment with a flame resistant gauze which acts as a spark arrester. The gauze can be mounted internally or externally of the outlet of the second section of the muffler, silencer or pre-silencer in a curved or conical shape to give sufficient area of gauze so as to create no excessive back pressure in the exhaust system. The baffle section can have an internal or external control valve which allows the amount of gas flow to be varied to control the back pressure with respect to engine revolutions per minute. This valve can be manually or automatically controlled.

The exhaust gas expansion section and the optional second section can for example be circular, rectangular, square, oval, elliptical, oblong or uneven in cross-section.

For further understanding of the nature and advantages of the invention reference should be had to the ensuing detailed description taken in conjunction with the accompanying drawings.

DESCRIPTION OF THE PREFERRED EMBODIMENTS

Examples of the present invention will be described with reference to use of the muffler or silencer with an internal combustion engine. It is, however, to be appreciated that with minor modifications or variations this invention can be used in other situations for controlling gas flows.

Figure 1:
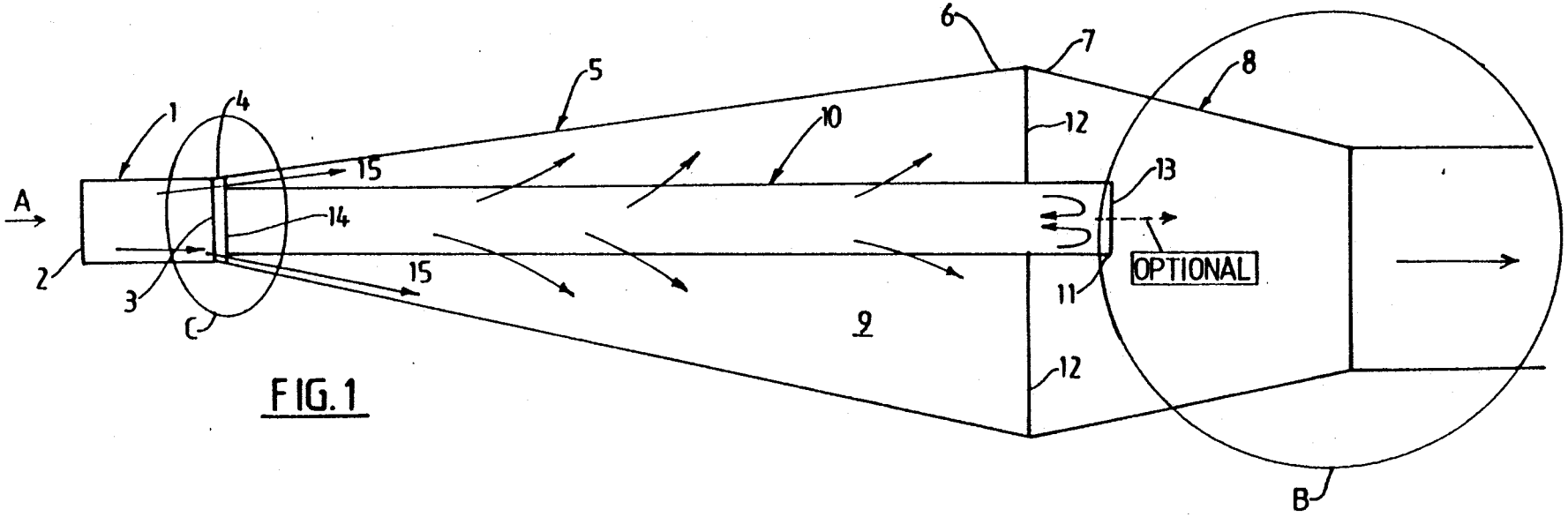
FIG. 1 is a diagrammatic section through an example of the muffler or silencer according to the invention.
Figure 2:
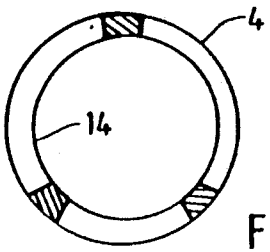
FIG. 2 is a view in the direction of arrow A of an end of the muffler or silencer shown in FIG. 1.

In the example shown in FIGS. 1 and 2 the muffler has an inlet connecting tube 1 the end 2 of which is adapted for connection to an outlet tube (not shown) of an internal combustion engine.

Figure 4:
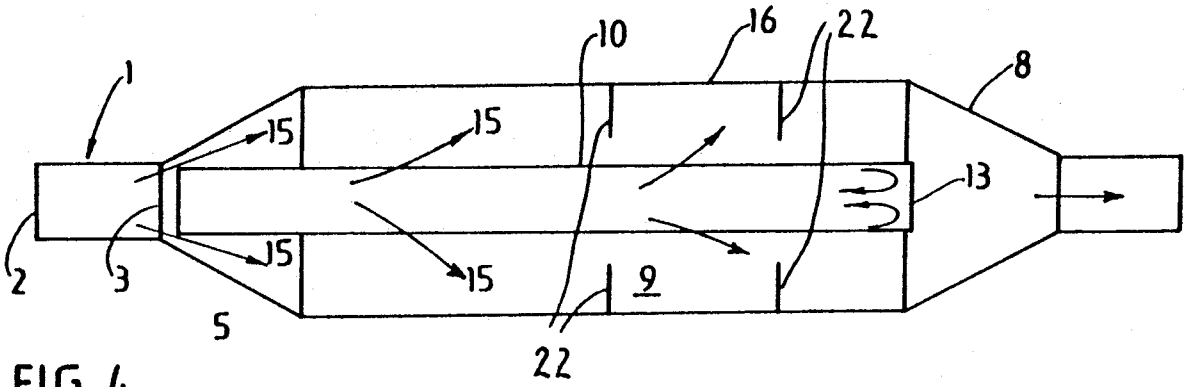
FIG. 4 is a diagrammatic section through an alternative construction of muffler according to the invention.

The other end 3 of the tube 1 is connected to a smaller end 4 of a first tapered gas expansion section 5 the large end 6 of which is, in the example, connected to the larger end of the second tapered section 8. The tube 1, the first tapered section 5 and second tapered section 8 are welded together using known welding techniques and if desired and as shown in FIG. 4 a length of straight pipe 16 can extend between the two tapered sections.

A chamber 9 formed by the first and second tapered sections has mounted therein a baffle tube 10. The baffle tube 10 can be perforated, plain or a louvred tube fixed in place in a variety of ways. In the example a free end 11 of the tube 10 is held in place by straps or stays 12 welded to the interior of either the first or second tapered sections. An end 13 of the baffle tube 10 can be partially or fully closed.

The first tapered section 5 creates an expanding cone tapered to suit an engines design torque characteristics and the expected r.p.m. range of the operation of the engine. The second tapered section 8 acts as a reducing cone that can also be dimensioned and shaped to suit a particular design.

The shape and cross section of the first and second tapered sections is not critical although a circular cross section is desirable. This may be completely formed or rolled instead of being a welded assembly.

The baffle tube 10 is mounted internally with its open end 14 positioned at or near the smaller end 4 of the expanding cone 5 to allow a flow of exhaust gases in the direction of the arrows 15 shown. It is critical that there be a gap around most of the periphery of the open end 14 of the baffle tube 10. This gap in use depends on the engine performance required.

Figure 3:
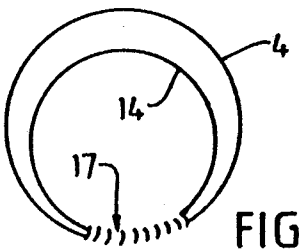
FIG. 3 is a view in the direction of arrow A of an alternative placement of an internal baffle for the muffler or silencer shown in FIG. 1.

In FIG. 3 is shown an alternative position for attaching the open end 14 of the baffle tube 10 to the end 4 of the cone 5. In this case the parts are welded together at 17.

Varying the space between the open end 14 of baffle tube 10 and the first tapered section 5 enables the muffler to be optimized for various gas flow requirements and/or rates of revolution of the internal combustion engine to which it is attached.

An alternative to varying the placement of the open end 14 in the baffle tube 10 relative to the tapered section 5 is to vary the length of the baffle itself thereby affecting the back pressure pulsing therefrom and the back pressure to the muffler. The degree of blockage or closing of the end 13 also has a similar effect.

In FIG. 4 the construction of the muffler is generally similar to that shown in FIG. 1 and the parts are referenced by the same numeral. This unit is used in the same manner as the first example. This unit is shown with additional baffles 22 in the space 9.

Figure 5:
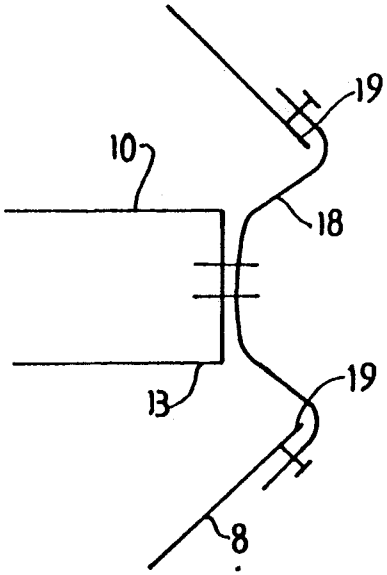
FIG. 5 is a detail of the region B of FIG. 1 showing an alternative construction with a spark arrester.

In FIG. 5 is shown a section of the end 13 of the baffle tube 10. The end 13 in this construction has a flame resistant gauze 18 fitted which also extends over the opening 19 of the conical section 8. The size and shape of the gauze 18 is such that there is no excessive back pressure to the exhaust system.

Figure 6:
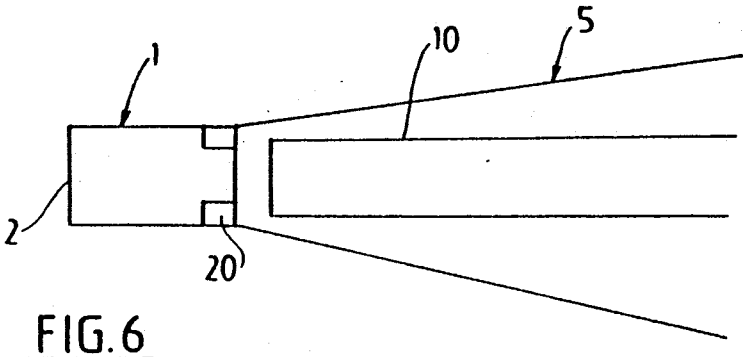
FIG. 6 is a detail of the region C of FIG. 1 showing an alternative construction at the front of the muffler.

In FIG. 6 are shown a series of protrusions 20 which may be formed by inserts or by contouring the welding at the join between the first connecting tube 1 and the expansion section 5. It has been found that the introduction of these protrusions 20 has an enhancing effect to the operation of the muffler.

Figure 7:
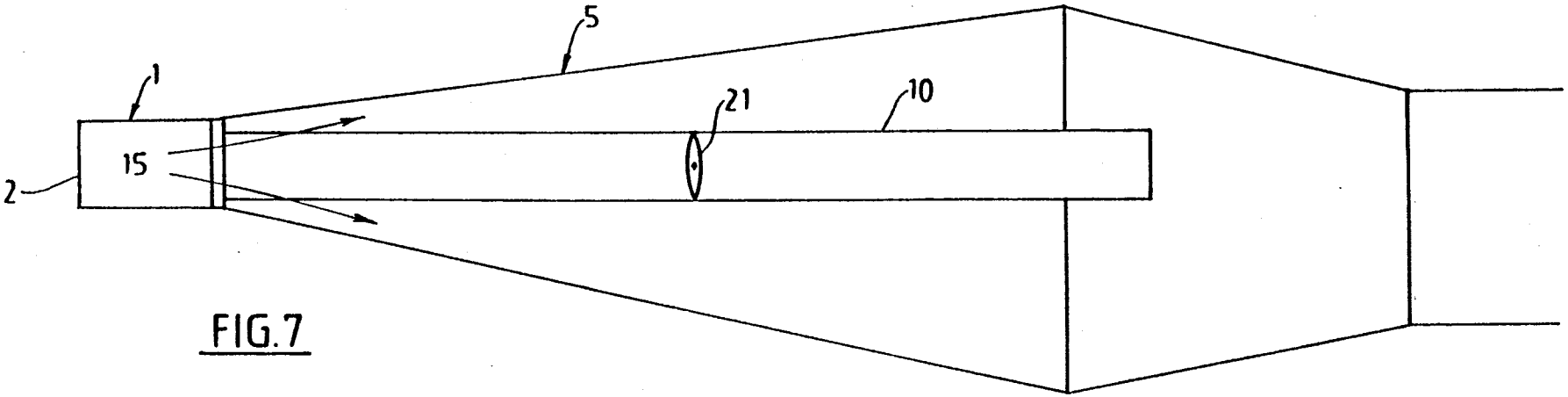
FIG. 7 is a diagrammatic section through an alternative construction of muffler according to the invention.

In FIG. 7 there is provided within the baffle section a valve 21. The valve 21 can be controlled electronically or mechanically to vary the back pressure to the engine as required during operation.

In use the examples and constructions shown in FIGS. 5 to 7 are used in the same manner as the first example.

Thus by this invention there is provided a high performance muffler, silencer or pre-silencer for controlling gas flows of internal combustion engines or gas flows.

The above description and illustrations should not be construed as limiting the scope of the invention, which is defined in the appended claims.

What I do claim and desire to obtain by Letters Patent of the United States is:

1. An apparatus for improving the performance of an engine comprising:

an exhaust gas expansion section having a forward inlet portion and an aft outlet portion, said forward inlet portion having an inside perimeter wherein said forward inlet portion has a smaller cross-sectional area than said aft outlet portion, said forward inlet portion being adapted for connection to an exhaust flow means of said engine; and a baffle having a first open end attached within said forward inlet portion of said exhaust gas expansion section, and a second partially closed end extending toward said aft outlet portion of said exhaust gas expansion section, said first open end having an outside perimeter, said second partially closed end having openings for passing exhaust gases into said exhaust gas expansion section.

2. The apparatus of claim 1 further comprising a second section wherein said second section has a forward inlet end for connecting to said aft outlet portion of said exhaust gas expansion section, an aft outlet end and two opposing longitudinal sides.

3. The apparatus of claim 2 wherein the relationship between said two opposing longitudinal sides of said second section is selected from the group consisting of parallel, convergent or divergent.

4. The apparatus of claim 1 wherein there is a peripheral gap between said outside perimeter of said first open end of said baffle and said inside perimeter of said forward inlet portion of said exhaust gas expansion section such that gas flow accelerates through said peripheral gap.

5. The apparatus of claim 2 wherein said engine is one of a pluralty of engines, said baffle having a length extending from said forward inlet portion of said exhaust gas expansion section toward said aft outlet portion of said exhaust gas expansion section wherein said length of said baffle is dependent upon the performance of said one of said engines.

6. The apparatus of claim 2 wherein a gauze cover is mounted at the end of said partially closed end of said baffle, said gauze cover acting as a spark arrester.

7. The apparatus of claim 6 wherein said gauze cover is mounted internally of said second section.

8. The apparatus of claim 7 wherein said gauze cover is mounted externally of said second section.

9. The apparatus of claim 2 wherein said exhaust gas expansion section and said second section are conical in shape and constructed of any suitable length and taper angles for the type of engine onto which said apparatus is to be fitted.

10. The apparatus of claim 2 further comprising an attachment means to secure said baffle to said forward inlet portion of said exhaust gas expansion section, wherein said baffle has a lateral position with respect to said forward inlet portion of said exhaust gas expansion section, said lateral position varied by said attachment means.

11. The apparatus of claim 2 wherein openings in said second partially closed end of said baffle can be varied.

12. The apparatus of claim 2 further comprising a control means for varying the size of said openings in said second partially closed end of said baffle.

13. The apparatus of claim 2 wherein said baffle is mounted centrally with respect to said forward inlet portion of said exhaust gas expansion section.

14. The apparatus of claim 2 further compromising a connecting tube for connecting said forward inlet portion of said exhaust gas expansion section to an exhaust pipe, wherein said connecting tube and said exhaust expansion section are provided with protrusions for increasing gas flow resistance.

15. The apparatus as in any of the preceding claims in which said baffle is perforated, and wherein a gas flows into said exhaust gas expansion section through said partially closed second end of said baffle and through said perforations in said baffle.

* * * * *